United States Patent [19]

von Eckardstein

[11] Patent Number: 4,708,288

[45] Date of Patent: Nov. 24, 1987

[54] METHOD AND APPARATUS FOR PNEUMATICALLY DISCHARGING HYDROMECHANICALLY CONVEYED HYDRAULIC BUILDING MATERIAL FOR UNDERGROUND OPERATIONS

[75] Inventor: Karl-Ernst von Eckardstein, Kamen, Fed. Rep. of Germany

[73] Assignee: Friedrich Wilh. Schwing GmbH, Fed. Rep. of Germany

[21] Appl. No.: 654,739

[22] Filed: Sep. 27, 1984

[30] Foreign Application Priority Data

Oct. 4, 1983 [DE] Fed. Rep. of Germany ..... 3335953924

Aug. 25, 1984 [EP] European Pat. Off. ..... 84110148

[51] Int. Cl.[4] ..... B05B 17/04

[52] U.S. Cl. ..... 239/9; 239/10; 239/400; 239/403; 239/427.5; 239/428; 239/432; 239/434

[58] Field of Search ..... 239/1, 8–11, 239/400, 403, 427.5, 428, 432, 433, 434

[56] References Cited

U.S. PATENT DOCUMENTS

| | | | |
|---|---|---|---|
| 1,751,195 | 3/1930 | Faber | 239/434 |
| 1,894,879 | 1/1933 | Lay | 239/428 |
| 2,075,867 | 4/1937 | Sampel | 239/432 |
| 2,083,851 | 6/1937 | Marcy | 239/428 |
| 2,495,540 | 1/1950 | Nichols et al. | 239/428 |
| 4,411,389 | 10/1983 | Harrison | 239/427.5 |

FOREIGN PATENT DOCUMENTS

| | | | |
|---|---|---|---|
| 855720 | 10/1977 | Belgium . | |
| 382988 | 10/1923 | Fed. Rep. of Germany . | |
| 1036497 | 8/1958 | Fed. Rep. of Germany . | |
| 1786579 | 1/1959 | Fed. Rep. of Germany . | |
| 1090837 | 10/1960 | Fed. Rep. of Germany . | |
| 1684204 | 11/1972 | Fed. Rep. of Germany . | |
| 3016854 | 11/1981 | Fed. Rep. of Germany . | |
| 614582 | 12/1948 | United Kingdom | 239/433 |

OTHER PUBLICATIONS

Soviet Inventions Illustrated, Derwant Publications Ltd., Week C 21 of Jul. 2, 1980; conclusion No. E6512, Q49; Soviet application 687239 (Poturaev V. N. et al.) of Oct. 10, 1979.

Publication Beton- und Stahlbetonbau, vol. 75, No. 3, Mar. 1980, Berlin; Bertil Sandell "Progresses in Sweden in Preparing Steelneedle Yet Propulsed Concrete," pp. 53–55 (FIG. 10 on p. 55).

German Publication (Jul. 1972) VDI-Z, p. 680 ("Geräte für den Betonbau-Betonspritz-machinen—Nassverfahren").

*Primary Examiner*—Andres Kashnikow
*Assistant Examiner*—Michael J. Forman
*Attorney, Agent, or Firm*—Kinney & Lange

[57] ABSTRACT

In a method and an apparatus for pneumatically discharging hydromechanically conveyed hydraulic building material for underground operations, in which compressed air is supplied to the wet building material, pumped in a dense stream, in front of a mouth piece serving the discharge thereof and having in particular a nozzle shape, the compressed air being gunned out together with the building material, the invention provides for the dense stream of the pumped building material to be supplied to the compressed air supplied in a stream, sealed off from the outside air by the wet building material, and thereby be distributed in the compressed air stream and conveyed with the latter to the mouth piece to be discharged therefrom.

6 Claims, 11 Drawing Figures

METHOD AND APPARATUS FOR PNEUMATICALLY DISCHARGING HYDROMECHANICALLY CONVEYED HYDRAULIC BUILDING MATERIAL FOR UNDERGROUND OPERATIONS

BACKGROUND OF THE INVENTION

1. Field of the Invention

The present invention relates to a method for pneumatically discharging hydromechanically conveyed hydraulic building material for underground operations according to the introductory part of claim 1. The invention also relates to an apparatus for carrying out this method.

2. Description of the Prior Art

Hydraulic building materials which are used underground are substances with consistencies ranging from granular to powderized and having different water/-solid factors, which are frequently processed with aggregates of synthetic material or fiber mixtures, among other things, during gunning. The invention relates in particular to gun-applied concrete made of these materials, or gun-applied mortar, which in turn is appled several centimeters thick to the stone walls of underworkings, in particular of drifts, leaving out the floor, as soon as possible after the roof fall has been won, for example by blasting, in order to increase the self-supporting capacity of the surrounding ground. In addition to this roof fall protection when driving rooms in mining and tunnel construction, the inventive method also serves the purpose of sealing fire and ventilation dams and smoothing walls in order to reduce air resistance, as well as for timbering in general. Activator, which is preferably liquid, may be added to the building material in the interests of early strength, in order to guarantee optimal bearing capacity after as short a time as possible to keep down the convergence of the rock stratification, among other things.

The hydromechanical conveyance of the wet building material, in particular in the form of mortar or concrete, is advantageous as compared to dry conveyance, which is also known, in the case of which the necessary mixing water and possibly the activator are added to the building material at the end of the pipeline, in that the applied layers have a uniform composition in accordance with a given recipe, which eliminates the fluctuations in the solidity of the applied layers resulting from uneven composition of the building material and uncontrolled addition of water. The invention therefore assumes a previously known method by which the building material is discharged by aid of a mouth piece, provided with a nozzle, of a conveying pipeline or tube assembly acted upon by a pump, and gunned onto the surface to be coated.

In the case of the previously known apparatus, the building material is conveyed hydromechanically in the axial direction of the nozzle. A short distance before the nozzle, compressed air is added to the hydromechanically conveyed stream via nozzle channels arranged radially in the mouth piece. The resulting acceleration of the building material is subject to limits, however. For the nozzle device must take the limited compressibility of the wet building material into consideration due to the danger of clogging. The hydromechanical conveyance of the building material has an aggravating effect on this when the building material, for example due to the reduced friction in the conveyor pipe, is conducted in the latter with a relatively large cross-section and cannot be supplied simultaneously by a distributor to a number of discharge pipes or tubes. For in such cases the hydromechanically conveyed stream must also be reduced to a smaller cross-section at the mouth piece, which is determined by the handling of the mouth piece with the necessary strength of an operator, provided manipulators or monitors cannot be used.

Since, regardless of these difficulties, the activator is preferably added only at the last minute due to the danger that the hardening building material might interfere with the paths of hydromechanical conveyance, this is done with one or more nozzles at the end of the hydromechanical conveyance path. However, this means that the activator does not mix completely and homogeneously with the hydraulic building material. The produced layers are therefore inhomogeneous where the required early strength is not attained. Furthermore, there are also losses of activator liquid which is then carried along by the radially directed air blast and leads to concentrations of noxious substances in the atmosphere.

This, along with other causes, may lead to rebound losses, i.e. a percentage of discharged building material which does not stick, but falls down. It is true that the percentages ranging from 30% to 40% which are usual in dry methods are not reached by the wet methods, but the quota of the latter has different causes. It depends, among other things, on the adhesive power of the building material, the angle of impact of the building material stream discharged from the mouth piece, and similar parameters. In particular, the systematic changes in the supporting capacity of the substratum hit by the gunned building material constitute one of the most important causes for rebounding. For regardless of the force of impact, for example, on a rock surface, the resistance of the substratum changes in the course of the application of the gunning layer and is generally lower the more the applied layer thickness increases. The early strength of the building material thus plays as much of a part in this connection as the quantity of building material discharged in each particular case. But the known apparatus does not allow for any control of the speed of impact or any use of activator to avoid excess rebound losses, at least not to the necessary extent.

SUMMARY OF THE INVENTION

The method of the present invention is based on the known scheme for applying hydraulic building material in underground operations, namely pumping the material through a conveying pipeline and gunning it from a nozzle onto the surface to be coated. With the present method, this is achieved in such a way that it can be better controlled, and in particular, offers the possibility of achieving higher economy while sparing the atmosphere. Further, the applied layers of building material are made more effective with the use of activators, and the new method also provides the conditions necessary for reducing systematic rebound losses that were a problem with prior application methods.

This problem is solved by the invention with the features. of claim 1. Expedient embodiments of the invention are the object of the subclaims.

In the inventive method, the building material is supplied to a conveying air stream in such a way that the dense stream of the building material is divided up and the resulting building material particles are accelerated in such a way that they remain suspended in the conveying air stream. This conveying air stream containing the building material in a density dependent, on the one hand, on the air speed and air quantity, among other things, and, on the other hand, on the quantity to be conveyed, can be discharged at the mouth piece without any danger of clogging, and may also be constricted in the case of nozzle-shaped mouth pieces and thus discharged at an increased speed, which essentially depends upon the quantity of compressed air when the cross-section and quantity being conveyed are given. On the other hand, the breaking up of the dense stream in which the building material is hydromechanically conveyed leads to an enlargement of the free building material area, which in turn offers favorable conditions for improving the inclusion of an activator, if used.

The invention thus offers the advantage of causing an essential reduction of the weight to be manipulated at the mouth piece and of discharging the building material in a loosened state, thus favoring an even distribution of the building material on the particular substratum and thereby causing a considerable reduction of rebound losses. The breaking up of the dense stream by means of the compressed air stream does not have any detrimental consequences for the building material because this process, insofar as it leads to a demixing of the building material, is revoked during impact. The air consumption is kept within tolerable limits because the resulting pneumatic conveying path is limited to the mouth piece and is relatively short.

Under these conditions, the improved possibility of using activators can be expediently exploited with the features of claim 2. The distribution of the activator in the compressed air stream, in particular, its atomization in the air stream, leads to a considerable increase in the number of activator particles, thereby accordingly increasing the probability that an activator particle meets a building material particle due to the relative speed of these particles resulting from the addition of the dense stream. This allows for a considerable reduction in the amount of activator used while at the same time obtaining a considerable improvement in the effectiveness of the activator.

This effect, which is desirable not only from the point of view of an economical use of activators, but also in view of the distribution of the building material particles in the conveying air stream, which should be as even as possible, can be reinforced by the features of claim 3. The turbulence of the compressed air stream can also contribute to increasing the density of the building material in the conveying air stream, thereby reducing the quantity of compressed air necessary for discharging the building material.

For this reason, the realization of the features of claim 4 is also expedient, because it considerably increases the relative speeds of the building material and compressed air, as opposed to the axial supply of the dense stream, so that the separation of the building material and the distribution of the resulting particles in the conveying air stream take shape more favorably.

The features of claim 5 allow for a reduction in the rebound losses, which up to now have increased disproportionately quickly, for systematic reasons, when the layer thickness increases. The reduction of the conveying air stream allows the pump used for hydromechanical conveyance, which is usually designed as a reciprocating pump but occasionally as a spiral pump, to work evenly with the given quantity to be conveyed but the quantity and speed of the building material contained in the impinging gunning stream can still be adapted.

The realization of the features of claim 6 offers the advantageous possibility of appropriately accelerating the building material discharged from the end of the hydromechanical conveying pipe from its relatively low speed to the considerably higher pneumatic conveying speed, and preventing sedimentation of synthetic material.

The reaction time required by one or more additives to the conveyed concrete to take effect, is of varying length depending on the additive. This reaction time must be sufficiently long. On the other hand, it must not exceed a certain period because otherwise the tendency to clogging is increased disproportionately. Therefore, the embodiment of the inventive method according to claim 7 is expedient, because the reaction time can be virtually predetermined according to this embodiment.

BRIEF DESCRIPTION OF THE DRAWINGS

The details, further features and other advantages of the invention can be found in the following description of embodiments of an apparatus suitable for performing the above method, with reference to the figures in the drawing. These show.

DETAILED DESCRIPTION OF THE PREFERRED EMBODIMENTS

Figure 1:
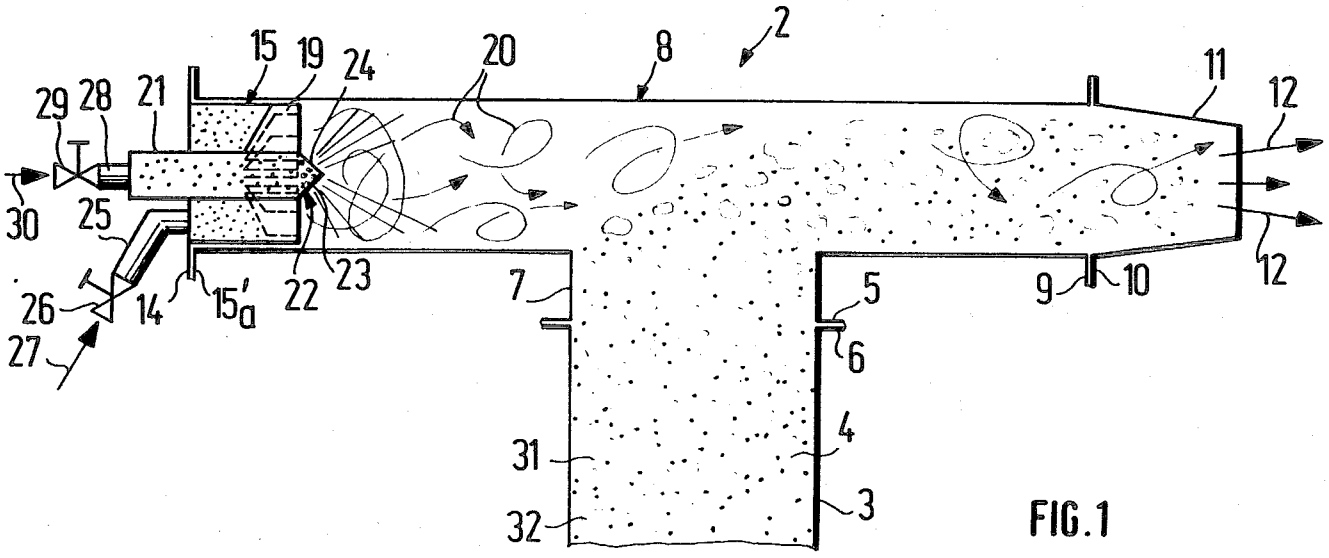
FIG. 1 a schematic and cut-off view of the construction of a mouth piece according to the invention, FIG. 2 a modified embodiment of the invention viewed according to FIG. 1, FIG. 3 an embodiment of the invention modified further, viewed according to FIGS. 1 and 2, FIG. 4 a variant of the embodiment according to FIG. 3, FIG. 5 a further variant of the embodiment according to FIGS. 3 and 4, FIG. 6 a schematic side view of the compressed air delivery in a mouth piece according to the invention, FIG. 7 a modified embodiment of the invention viewed according to FIG. 1, FIG. 8 an embodiment modified further with respect to the view in FIG. 7.

Mouth piece 2 shown in FIG. 1 is located on the end of a conveyor pipeline 3 of a known hydromechanic conveyor system for gunned concrete, the details of which are not reproduced here, the system being shown schematically. Mouth piece 2 is screwed by aid of an annular flange 5 onto matching annular flange 6 of conveyor pipe 3, a tube connector being located between pipe 3 (shown cut-off) and a stationary conveyor pipeline.

Mouth piece 2 consists of a T-shaped pipe, the vertical part of which is formed by a section of pipe 7 exhibiting flange 5 and branching off at right angles to pipe 8, which is narrower by comparison, of the mouth piece. Pipe 8 is connected by flange 9 to a corresponding flange 10 of a nozzle 11, out of which the building material emerges in accordance with arrows 12.

Figure 6:
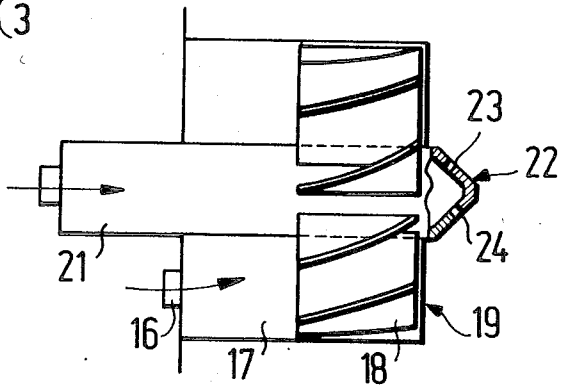

At the opposite end, a compressed air connection 15 is connected by aid of a flange 14 to a matching flange 15' of pipe 8. The details of the compressed air connection 15 cah be seen in the view of FIG. 6.

The compressed air supplied at 16 then enters a tubular chamber 17, first passing blades 18 of a control device 19. These blades generate angular momentum followed by turbulence in the air stream, which is indicated by arrows 20 in the figures.

A further pipe 21 is attached concentrically in tubular chamber 17, the front end of this pipe 21 being provided with a conical seal 22 protruding beyond control device 19. The conical seal has several openings 23, 24 on its conical surface, through which a preferably liquid activator can penetrate. The conical seal is generally equipped in practice with high-pressure atomizing nozzles for liquid activators.

According to the view in FIG. 1, the compressed air is supplied via a connection piece 25 with blockage and control unit 26 in accordance with arrow 27. The activator is also supplied to pipe 21 via a connection piece 28, a blockage and control unit 29, in accordance with arrow 30.

In operation, a reciprocating pump continuously delivers building material 4 consisting of a hydraulic substance whose consistency ranges from granular to powderized, water, sand 31 and aggregates 21, through connection piece 7 into pipe 8. The extremely turbulent compressed air stream following control device 19 carries along the activator penetrating through openings 23, 24, distributing it in a form ranging from mist to drops over the entire clear opening of pipe 8. Building material 4 is added to this turbulent compressed air stream in accordance with the hydromechanical conveyance at the opening of connection piece 7. At the same time the compact stream is broken up and separated into particles which are kept in suspended distribution in the compressed air stream. The building material particles carried along by the stream reach nozzle 11 and are discharged by same in accordance with arrows 12. In free flight they cross the distance to a surface (stone surface), on which they settle down in the form of an uninterrupted layer.

Figure 2:
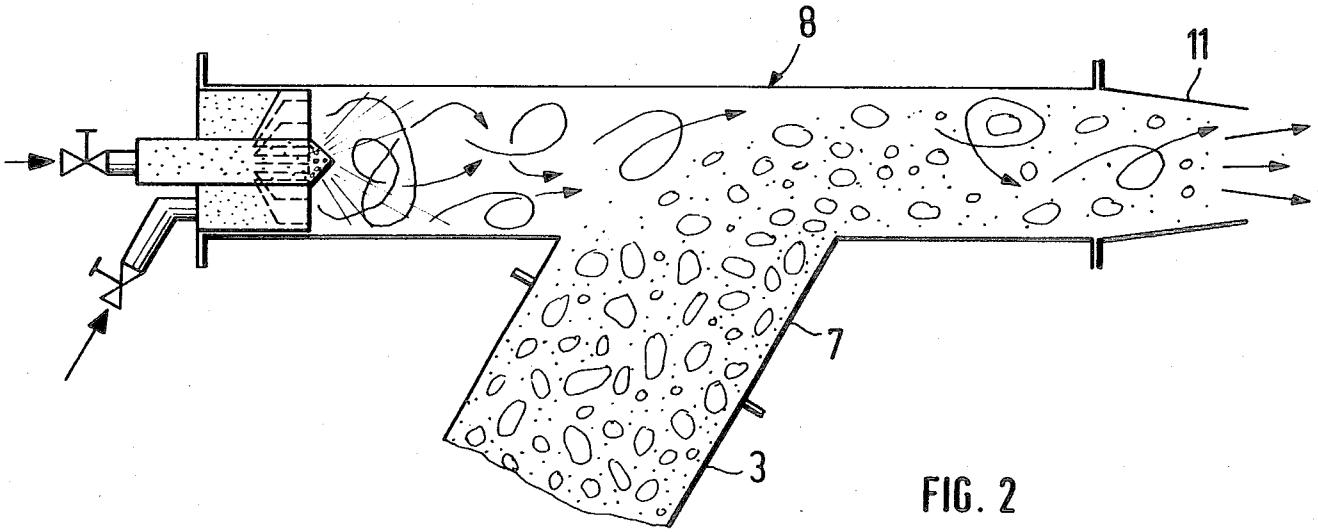

According to the embodiment of FIG. 2, pipe section 7 and flanged pipe 3 are not arranged at right angles, but at an acute angle to the pipe. This favors the hydromechanical conveyance by reducing supply resistance, and may therefore have a favorable effect under certain circumstances.

Figure 3:
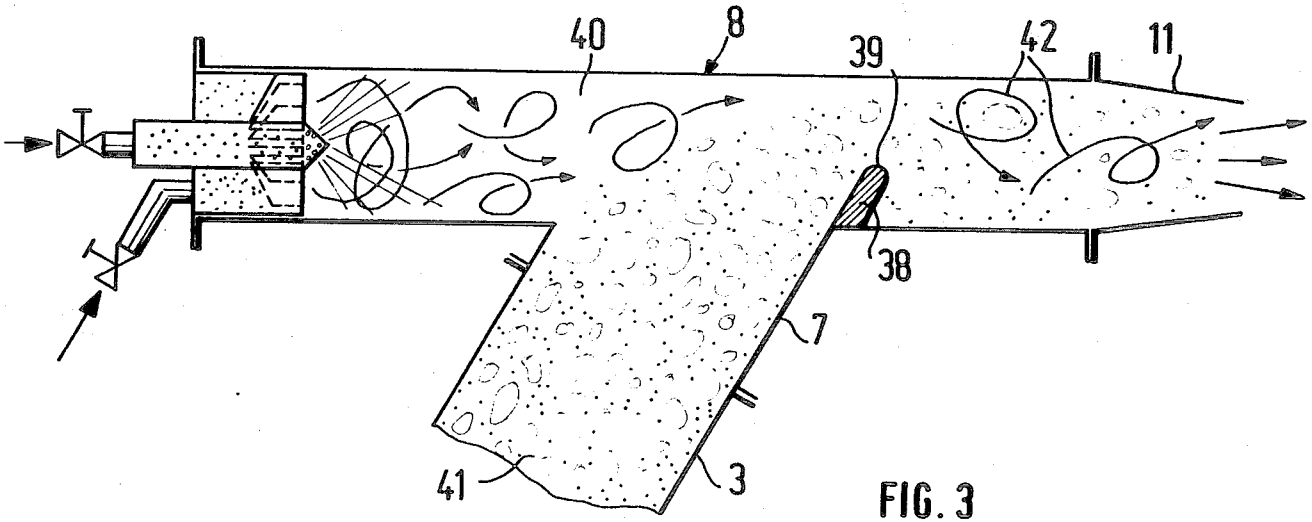

According to the view of FIG. 3, the cross-section of mouth piece pipe 8 is reduced behind the opening of pipe section 7 by a stationary plate, the baffle plate of which is shown at 38. This baffle plate consists of a weir limited by the circular walling of the pipe, the edge of the weir exhibiting a round inside surface 39. Baffle plate 38 creates a cross-sectional reduction restricting the compressed air stream 40, whereby turbulence which favors the separation of dense stream 41 through pipes 3 and 7 comes about additionally on surface 39. Some of this turbulence is shown schematically at 42.

Figure 4:
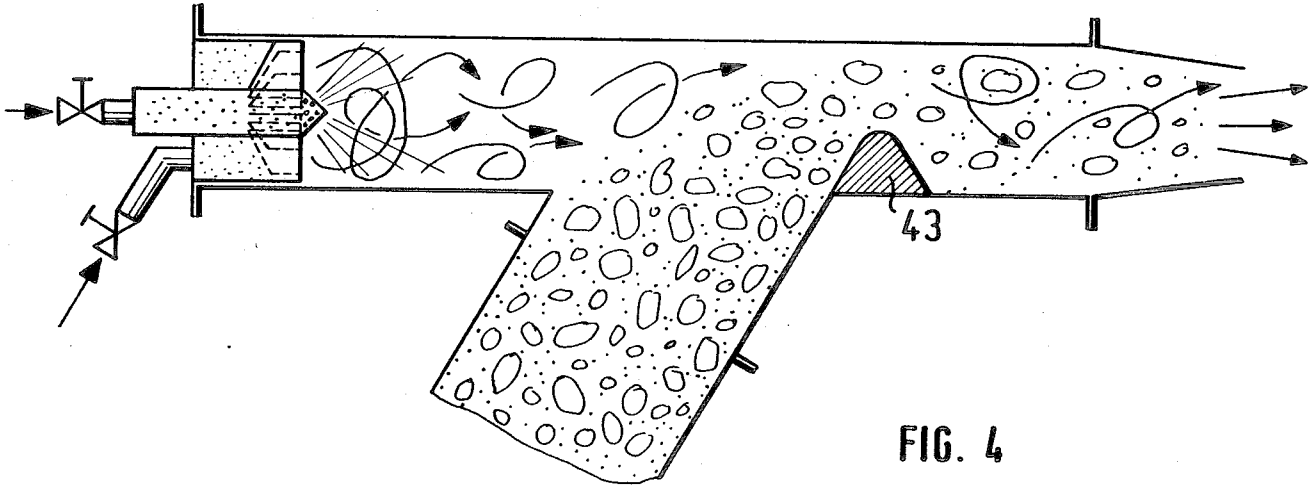

The embodiment according to FIG. 4 uses, instead of the disk shape of baffle plate 38, a plate 43 with a trapezoidal cross-section in order to counteract sedimentation in its turbulent region.

Figure 5:
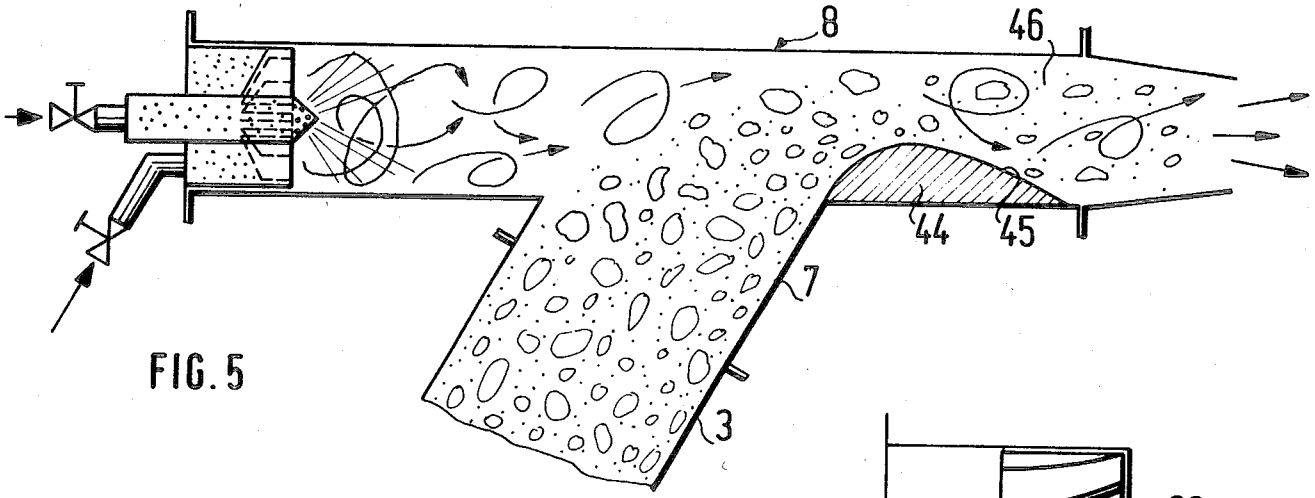

This tendency is counteracted even more by the embodiment according to FIG. 5, because here the cross-section of plate 44 in nozzle pipe 8 exhibits a bulge 45 on which conveying air stream 46, which forms following the opening of pipe 7, is accelerated.

Figure 7:
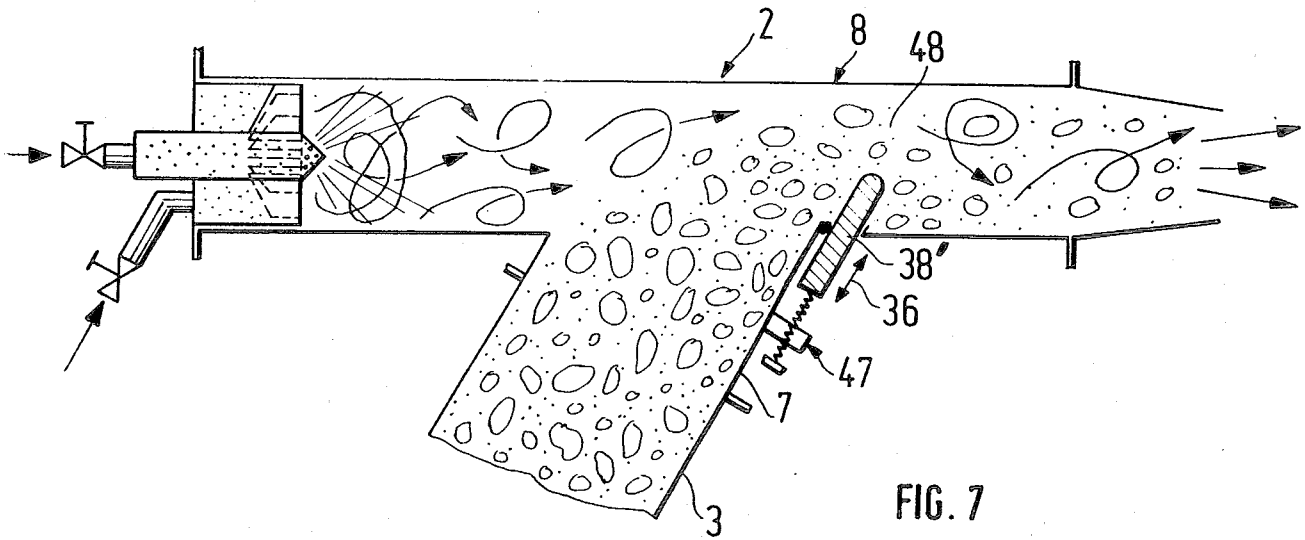

In the embodiment according to FIG. 7, an adjustable baffle plate 38' is displaceable in the cross-section of nozzle pipe 8 in the direction of double arrow 36 that is the direction of pipe section 7 by aid of a regulating device 47. This results in the possibility of setting up an adjustable aperture 48 in the pipe 8 which the conveying air stream must go through immediately following the opening of pipe 7. Such an adjustable plate 38 allows mouth piece 2. to be adjusted to accommodate different compositions of building material, such as different water/solid factors.

Figure 8:
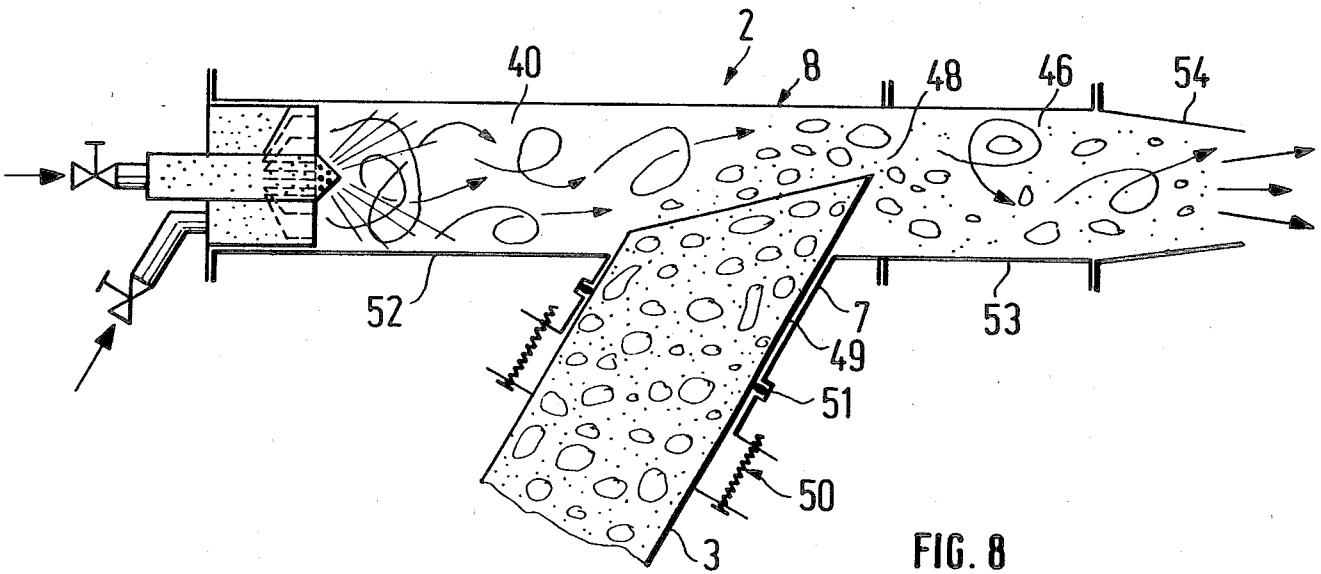

In the embodiment according to FIG. 8, a telescopic pipe 49 displaceable in pipe 7 is used insstead of an adjustable plate 38' to adjust the cross-section of the aperture 48 in nozzle pipe 8. The telescopic pipe 49 forms the extension of pipeline 3, which may be axially displaced and adjusted in pipe 7 by aid of an annular adjusting device 50. A seal 51 seals off the casing of pipe 49, preventing compressed air of compressed air stream 40, or conveying air stream 46 in mouth piece pipe 8, from escaping from the nozzle. The axial adjustability of telescopic pipe 49 makes it possible to alter the cross-section of aperture 48 in a particularly easy manner. Furthermore, pipe 8 has a multipart design in the view of FIG. 8, consisting of pipe sections 52, 53 and nozzle 54. This means that not only flanged nozzle 54 can be removed, but also the following pipe 53, which makes it considerably easier to remove clogs and service mouth piece 2.

In operation, both the quantity of activator may be controlled, by blockage and control unit 29, and the quantity of compressed air, by blockage and control unit 26. The supply of compressed air may be controlled via control unit 26 in such a way that the speed at which the conveying air stream at 12 is discharged may be slowed down in accordance with the construction of the layer.

The additives, in particular activators, added to the hydraulic building material being conveyed are frequently contaminated. In many cases the additives may be inhomogeneous. When relatively large quantities of such additives must be conveyed, clogging often occurs.

One or more additives can only take effect in the concrete material being conveyed after a reaction period which depends upon the conditions of the particular case. This results in the sojourn time of the concrete, which is already mixed with the additives, being as long as possible, but not too long, in the entire apparatus. Under these circumstances, a mouth piece provided on a tube has the advantage that it makes it possible to determine the reaction time by means of the length of the tube and the rate of flow. A tube also has the advantage that the gunning apparatus proper does not need to be carried or handled, but only the much lighter replaceable tube, in which the concrete is conveyed to the mouth piece in the tunnel stream as described.

In order to realize the necessary length of tube, on the one hand, and not to extend the sojourn time too long, on the other, the speed of the concrete may be increased before the mouth piece. This is accomplished expediently by a discharge pipe or a discharge tube having a smaller cross-section than the concrete inflow. Such a design also has the advantage that extremely small quantities of concrete may also be processed because the discharge tube has a relatively small cross-section.

If the mouth piece is provided with a nozzle, the usual conversion of pressure to speed takes place in the nozzle. In case such an increase of speed is not required at the discharge, the nozzle may be dispensed with.

I claim:

1. An improved method for pneumatically discharging hydromechanically conveyed hydraulic building material from a nozzle wherein, upstream from the nozzle the building material, which is pumped toward the nozzle in a dense stream, is combined with an activator for accelerating the hardening of the building material and also united with a compressed air stream so that the building material and activator are entrained in the air stream and conveyed thereby to the nozzle for discharge therefrom, the improvement comprises the steps of:

causing the air stream to be turbulent when it encounters the dense stream of building material; and distributing the activator to the turbulent air stream before it encounters the dense stream of building material.

2. The improved method according to claim 1 wherein the activator is a liquid.

3. The improved method according to claim 1, characterized in that the dense stream of building material and the turbulent air stream are combined at an intersection angle ranging from acute to 90°, both streams flowing toward the apex of the intersection angle.

4. The improved method according to claim 1, and further comprising the step of:

controlling the rate of flow of the compressed air stream to the dense stream in order to determine the rate of discharge of building material from the nozzle.

5. The improved method according to claim 1, and further comprising the steps of:

first constricting the cross-sectional area, upstream of the nozzle, through which the conveying air stream passes; and then expanding the cross-sectional area, upstream of the nozzle, through which the conveying air stream passes.

6. The improved method according to claim 1, wherein the activator and building material have a reaction time, and further comprising the steps of:

passing the conveying air stream through a discharge pipe, upstream from the nozzle; and controlling the reaction time by varying the length and cross-sectional area of the discharge pipe.

* * * * *